US007623083B2

(12) United States Patent
Chung

(10) Patent No.: US 7,623,083 B2
(45) Date of Patent: Nov. 24, 2009

(54) PLANAR ANTENNA UTILIZING CASCADED RIGHT-HANDED AND LEFT-HANDED TRANSMISSION LINES

(75) Inventor: Shyh-Jong Chung, Hsinchu (TW)

(73) Assignee: Arcadyan Technology Corporation, Hsinchu (TW)

( * ) Notice: Subject to any disclaimer, the term of this patent is extended or adjusted under 35 U.S.C. 154(b) by 182 days.

(21) Appl. No.: 11/882,121

(22) Filed: Jul. 31, 2007

(65) Prior Publication Data

US 2009/0033558 A1 Feb. 5, 2009

(51) Int. Cl.
*H01Q 1/38* (2006.01)
*H01Q 9/00* (2006.01)
*H01Q 13/10* (2006.01)

(52) U.S. Cl. ..... 343/767; 343/749; 343/700 MS

(58) Field of Classification Search ..... 343/749, 343/700 MS, 767

See application file for complete search history.

(56) References Cited

U.S. PATENT DOCUMENTS 7,006,048 B2 * 2/2006 Chang ..... 343/767

7,446,712 B2 * 11/2008 Itoh et al. ..... 343/700 MS

* cited by examiner

*Primary Examiner*—Douglas W Owens
*Assistant Examiner*—Jennifer F Hu
(74) *Attorney, Agent, or Firm*—Bacon & Thomas, PLLC

(57) ABSTRACT

A planar antenna structure is provided. The planar antenna includes a dielectric substrate, a ground plane, a first conductive pattern and a second conductive pattern. The dielectric substrate has a first surface and a second surface. The ground plane is on the second surface of the dielectric substrate. The first conductive pattern is on the first surface of the dielectric substrate, coupled to a feeding line. The second conductive pattern is on the second surface of the dielectric substrate, coupled to the ground plane. The first and second conductive patterns are coupled to serve as cascaded right- and left-handed transmission lines. The first and second conductive patterns include: a first lumped equivalent circuit of the right-handed transmission line; and a second lumped equivalent circuit of the left-handed transmission line, cascaded with the first lumped equivalent circuit, wherein the right- and left-handed transmission lines have electrical lengths with opposite signs respectively.

18 Claims, 10 Drawing Sheets

PLANAR ANTENNA UTILIZING CASCADED RIGHT-HANDED AND LEFT-HANDED TRANSMISSION LINES

BACKGROUND OF THE INVENTION

1. Field of the Invention

The invention relates in general to a planar antenna, and more particularly to a planar antenna utilizing right-handed and left-handed transmission lines.

2. Description of the Related Art

In the wireless and mobile communication applications, the wireless devices, such as mobile phones, wireless network cards, and other mobile computing devices, are desired to be compact in size. One important factor for compactness of the wireless devices is to reduce the size of their antennas.

The basic half-wavelength center-fed dipole and quarter-wavelength monopole or ground plane are still widely used. However, numerous variations have been created to improve performance or adapt to limited physical conditions. One popular antenna is the inverted-F antenna, which can be found on mobile phones, WLAN hardware, and other small wireless devices. The performance is similar to a quarter-wave ground plane. Another example is a patch antenna. The patch antenna spans about one half-wavelength in diameter, which has a slight gain and strong radiation in a direction perpendicular to the patch and is used in some 802.11 wide local-area-network (WLAN) antennas.

The above-mentioned antennas are conventional right-handed transmission line (RH TL), characterized by the delay phase changing. In contrast, a left-handed transmission line (LH TL) is characterized by the advance phase changing. The LH TL occurs due to the study and discussion about metamaterial recently. Specifically left-handed materials (LHMs) possessing negative refractive index have drawn tremendous interests in both scientific and engineering fields. This kind of artificial structure has been utilized for many guided and unguided wave applications. The unique characteristics have been considered to be valuable topics.

Antennas using left-handed transmission lines are proposed by researchers using sophisticated and complex structure for their designed operation characteristic. One kind of practical approaches to synthesize LHMs is based on the backward wave supported by a distributed or equivalent lumped ladder network. With the advantage of backfire-to-endfire scanning, electronically scanned leaky-wave antennas were designed for the desired operation characteristics.

A composite Right/Left-Handed Transmission Line (CRLH TL) has also been developed wherein RH TL and LH TL can be embedded into each other. However, in implementation, the circuit elements of a CRLH TL are valid for very small electrical length $\theta$ with the same accuracy as $\sin\theta$ approaches unity. The zeroth-order resonance (ZOR) makes use of the opposite phase properties of RH and LH TL and has been proved experimentally. The physical size of such antenna can be arbitrary regardless the operation frequency since it is specified by the value of the capacitances and inductances instead of the wavelength. However, it has relatively less compact size including the matching structure.

SUMMARY OF THE INVENTION

The invention is directed to a planar antenna utilizing cascaded right-handed and left-handed transmission lines of equal amount electrical length with opposite signs. Implemented with lumped equivalent circuits of the transmission lines, a planar antenna has its size be arbitrarily specified according to lumped elements of capacitances and inductances, regardless of the operation frequency of the planar antenna. In this manner, planar antennas with different compact sizes and performances can be obtained by way of different layouts.

According to a first aspect of the invention, a planar antenna structure is provided. The planar antenna includes a dielectric substrate, a ground plane, a first conductive pattern and a second conductive pattern. The dielectric substrate has a first surface and a second surface. The ground plane is on the second surface of the dielectric substrate. The first conductive pattern is on the first surface of the dielectric substrate, coupled to a feeding line. The second conductive pattern is on the second surface of the dielectric substrate, coupled to the ground plane, wherein the first conductive pattern is coupled to the second conductive pattern so as to serve as a cascade of a right-handed transmission line and a left-handed transmission line. The first and second conductive patterns comprise: a first lumped equivalent circuit of the right-handed transmission line; and a second lumped equivalent circuit of the left-handed transmission line, cascaded with the first lumped equivalent circuit, wherein the right-handed and left-handed transmission lines have electrical lengths with opposite signs respectively.

According to a second aspect of the invention, a planar antenna apparatus is provided. The planar antenna apparatus includes a dielectric substrate, a ground plane, a feeding line, and an antenna section. The dielectric substrate has a first surface and a second surface opposite to the first surface. The ground plane is on the second surface of the dielectric substrate. The feeding line is disposed on the first surface of the dielectric substrate. The antenna section is based on a portion of the dielectric substrate. The antenna section includes a first conductive pattern and a second conductive pattern. The first conductive pattern is disposed on the first surface of the portion of the dielectric substrate, the feeding line being coupled to the first conductive pattern. The second conductive pattern is disposed on the second surface of the portion of the dielectric substrate and connected to the ground plane, wherein first conductive pattern is coupled to the second conductive pattern so as to serve as a cascade of a right-handed transmission line and a left-handed transmission line. The first and second conductive patterns comprise: a first lumped equivalent circuit of the right-handed transmission line; and a second lumped equivalent circuit of the left-handed transmission line, cascaded with the first lumped equivalent circuit, wherein the right-handed and left-handed transmission lines have electrical lengths with opposite signs respectively.

The invention will become apparent from the following detailed description of the preferred but non-limiting embodiments. The following description is made with reference to the accompanying drawings.

DETAILED DESCRIPTION OF THE INVENTION

Figure 1:
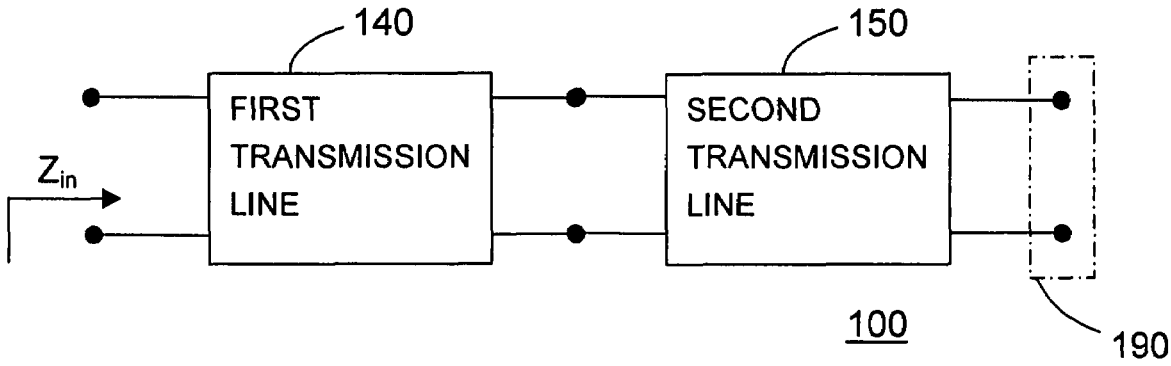
FIG. 1 illustrates an antenna utilizing cascaded right-handed and left-handed transmission lines according to a first embodiment of the invention.

Referring to FIG. 1, an antenna utilizing cascaded right-handed and left-handed transmission lines is illustrated according to a first embodiment of the invention. The antenna 100 comprises a first transmission line 140 and a second transmission line 150 cascaded with the first transmission line 140. The first and second transmission lines 140 and 150 are a cascade of right-handed and left-handed transmission lines and each has an equal amount of electrical length with opposite sign. In addition, one port 190 of the second transmission line 150 can be either open-circuited or short-circuited. A right-handed transmission line (RH TL) has a positive electrical length indicating phase delay while a left-handed transmission line (LH TL) has a negative electrical length indicating phase advance. Thus, the input impedance $Z_{in}$ of the antenna has zero imaginary part, which is a basic requirement for resonance. For examples, the first transmission line 140 can be an RH TL and the second transmission line 150 is an LH TL, and vice versa.

Figure 5A:
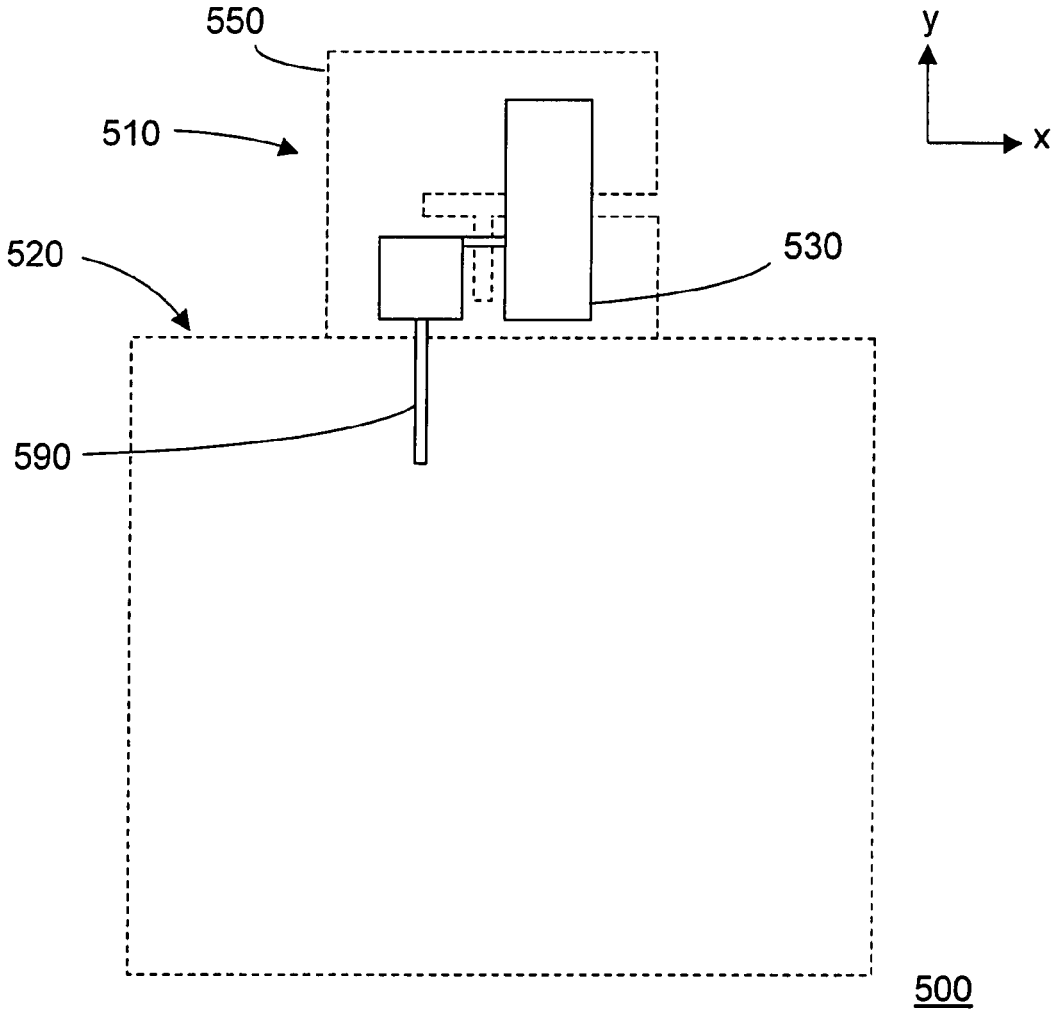
FIG. 5A illustrates a front view of a planar antenna apparatus including the antenna in FIG. 1, according to a second embodiment of the invention.

Besides, each of the transmission lines of the antenna 100 can be implemented by using an equivalent circuit model for a transmission line segment. In this manner, the antenna 100 can be implemented with lumped circuits. Based on this antenna structure, a communication apparatus or an antenna apparatus, such as a mobile phone or a wireless network card, can be derived. As an example that will be detailed in the subsequent description, an antenna apparatus 500 in FIG. 5A is based on a planar dielectric substrate with two opposite planar surfaces. A portion of the planar dielectric substrate is regarded as an antenna section 510, where lumped equivalent circuits of the transmission lines of the antenna 100 can be implemented. The first planar surface of the antenna section 510 (e.g. a top surface) has a first conductive pattern 530 while the second planar surface of the antenna section 310 (e.g. a bottom surface) has a second conductive pattern 550. With a ground plane 520, the first conductive pattern 530 and the second conductive pattern 550 are electrically coupled together to serve as the antenna 100. Since the antenna 100 may be implemented with different lumped circuits equivalent to a cascade of RH and LH transmission lines, it should be noted that the conductive patterns shown in the antenna section 510 are for illustration's sake and may be implemented in other patterns in other embodiments of the invention.

Figure 2A:
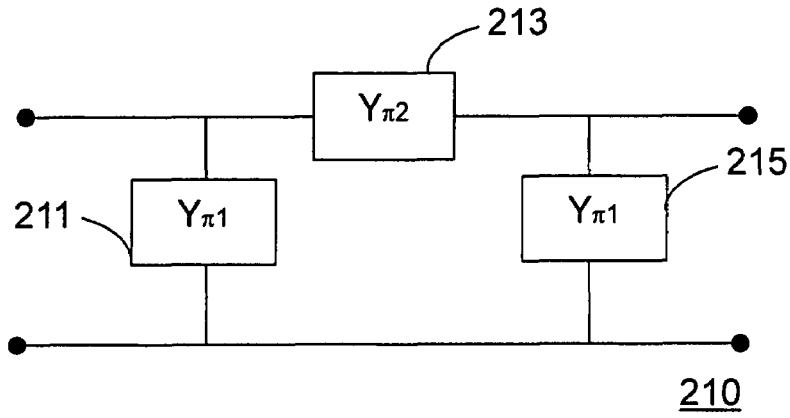
FIGS. 2A and 2B are examples of equivalent circuits, which can be employed as either right-handed or left-handed transmission line in the antenna in FIG. 1.
Figure 2B:
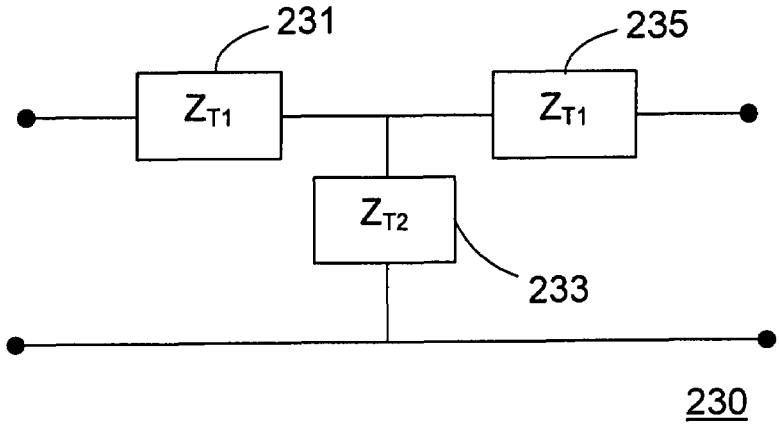

FIGS. 2A and 2B are examples of equivalent circuit models, each of which can be employed as either a RH TL or a LH TL of the antenna in FIG. 1. FIG. 2A is a π-model equivalent circuit 210 including two equal susceptances 211 and 215, denoted by $Y_{\pi 1}$, and a susceptance 213, denoted by $Y_{\pi 2}$. FIG. 2B is a T-model equivalent circuit 230 including two equal reactances 231 and 235, denoted by $Z_{T1}$, and a reactance 233, denoted by $Z_{T2}$.

In implementation, circuit parameters can be designed from equivalent circuit models for requirements of applications. As an example, with a characteristic impedance $Z_0$, an operation frequency $f_0$, and an electrical length θ, a certain length of transmission line can be modeled by either π or T equivalent circuit. The circuit elements showed in FIGS. 2A and 2B have the following relationships:

$$Y_{\pi 1}=jY_0(\csc\theta-\cot\theta)$$

$$Y_{\pi 2}=-jY_0\csc\theta$$

$$Z_{T1}=jZ_0(\csc\theta-\cot\theta)$$

$$Z_{T2}=-jZ_0\csc\theta \qquad \text{(F1)}$$

where $Y_0=1/Z_0$. These formulas, indicated by (F1), can be derived by comparing the ABCD matrix for the transmission line segment with the ABCD matrix for π and T circuits at a design frequency, for example, 2.45 GHz for use in wireless network communications.

Figure 3A:
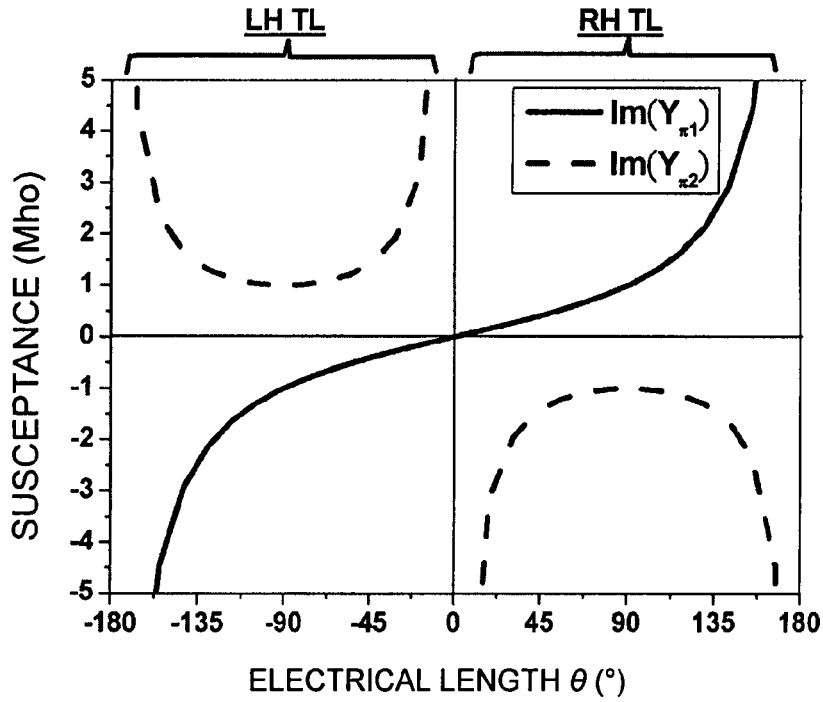
FIGS. 3A and 3B are graphs of the susceptances and reactances, as functions of the electrical length, for the equivalent circuits of FIGS. 2A and 2B.
Figure 3B:
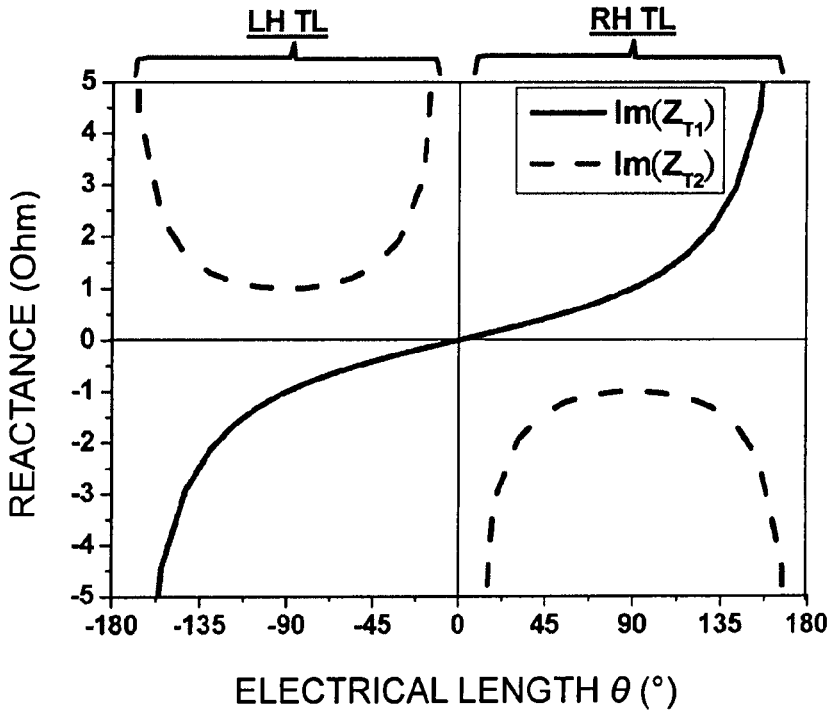

The susceptances of $Y_{\pi 1}$, $Y_{\pi 2}$ and the reactances of $Z_{T1}$, $Z_{T2}$, as functions of the electrical length θ, for the normalized component values with $Y_0=1$ and $Z_0=1$ are showed in FIGS. 3A and 3B, respectively. In FIG. 3A, a solid curve crossing the origin shows the relationship between the susceptance $Y_{\pi 1}$ and the electrical length while the relationship between the susceptance $Y_{\pi 2}$ and the electrical length is indicated by dashed curves. In FIG. 3B, the solid curve crossing the origin shows the relationship between the reactance $Z_{T1}$ and the electrical length while the relationship between the reactance $Z_{T2}$ and the electrical length is indicated by dashed curves. The upper half plane in FIG. 3A and the lower plane in FIG. 3B indicate capacitive elements whereas the lower half plane in FIG. 3A and the upper plane in FIG. 3B indicate inductive elements. Following such characteristics, formulas for the inductors (L) and capacitors (C) of equivalent transmission line models are listed in TABLE I, where $\omega_0=2\pi f_0$. The equivalent circuits (EQC) for the transmission line models are the π model for LH TL ($\pi_{LH}$), the π model for RH TL ($\pi_{RH}$), the T model for LH TL ($T_{LH}$), and the T model for RH TL ($T_{RH}$). The notation $L_{L\pi}$, for example, represents the value of the inductor of the π model for LH TL. The other notations representing the circuit elements of other circuit model in TABLE I can be explained readily in the similar manner to the notation $L_{L\pi}$ and will not be detailed for the sake of brevity.

TABLE I

Formulas of L and C for a TL Segment

| EQC | FORMULAS FOR L | FORMULAS FOR C |
|---|---|---|
| $\pi_{LH}$ | $L_{L\pi} = \frac{Z_0}{(\csc\theta - \cot\theta)\omega_0}$ | $C_{L\pi} = \frac{1}{Z_0\omega_0\sin\theta}$ |
| $\pi_{RH}$ | $L_{R\pi} = \frac{Z_0\sin\theta}{\omega_0}$ | $C_{R\pi} = \frac{(\csc\theta - \cot\theta)}{Z_0\omega_0}$ |
| $T_{LH}$ | $L_{LT} = \frac{Z_0}{\omega_0\sin\theta}$ | $C_{LT} = \frac{1}{Z_0\omega_0(\csc\theta - \cot\theta)}$ |
| $T_{RH}$ | $L_{RT} = \frac{Z_0(\csc\theta - \cot\theta)}{\omega_0}$ | $C_{RT} = \frac{1}{Z_0\omega_0\sin\theta}$ |

Figure 4A:
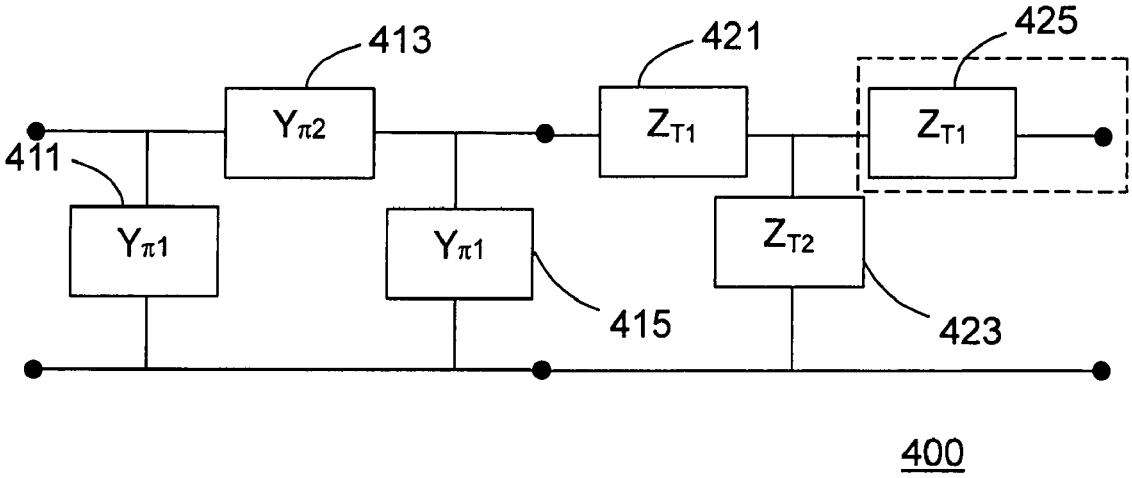
FIG. 4A shows an equivalent circuit for the antenna of FIG. 1 including a cascade of a π circuit for RH TL and a T circuit for LH TL, according to one embodiment of the invention.

In the following, several embodiments of the antenna 100 will be described and developed, where the first transmission line 140 is taken as a RH TL and the second transmission line 150 as a LH TL. Each transmission line segment can be modeled as an equivalent circuit such as either π or T circuit shown in FIGS. 2A and 2B above, thus leading to four combinations of equivalent circuits. For illustration's sake, a π circuit for RH TL and a T circuit for LH TL are chosen and connected with one port of the second transmission line being open-circuited, which is the unconnected port of the LH TL, as shown in FIG. 4A. The circuit 400 in FIG. 4A for the antenna 100 includes the π circuit for RH TL with circuit elements 411, 413, 415, and the T circuit for LH TL with circuit elements 421, 423, 425. In view of simplicity, the circuit element 425 of the T circuit in FIG. 4A is unnecessary since it is connected to the open-circuit port. As a result, a simplified lumped circuit 450 based on FIG. 4A is obtained in FIG. 4B, where $C_1=C_2=C_{R\pi}$, $L1=L_{R\pi}$, $C_3=C_{LT}$, and $L_2=L_{LT}$. This structure in FIG. 4A can result in a via-free layout of the antenna 100 with simple fabrication processes.

In order to have a compact structure, the design of the circuit parameters is considered. Referring to FIGS. 3A and 3B, choosing θ close to either 0 or 180 degrees leads to very large L or C value. Therefore, θ is chosen to be 90 degrees so as to keep a small circuit area. In addition, relatively larger capacitors rather than larger inductors are preferably employed in order to implement the antenna according to the invention with patch or patch-like radiation patterns. In order to avoid large inductors and mainly have patches in the physical structure of the antenna, a relatively small $Z_0$ is preferred, for example, when using formulas in TABLE I to design circuit parameters.

Figure 5B:
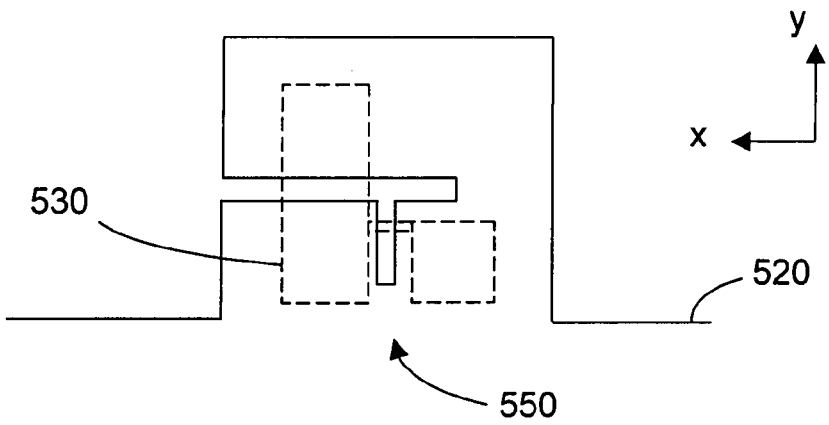
FIG. 5B illustrates a back view of the planar antenna in FIG. 5A.

Regarding the implementation of the lumped circuit 450 for the antenna 100, a planar antenna apparatus shown in FIG. 5A is provided, on which the lumped circuit 450 can be laid out, according to a second embodiment of the invention. The planar antenna apparatus 500 is based on a planar dielectric substrate including two opposite planar surfaces or layers, for example, a first planar surface and a second planar surface. The planar dielectric substrate can be a printed circuit board (PCB), such as FR4 or other multi-layered PCB. An antenna section 510 is based on a portion of the planar dielectric substrate, where lumped circuits equivalent to the transmission lines of the antenna 100 can be laid out. In FIG. 5A, the first planar surface of the antenna section 510 (e.g. an upper surface) has a first conductive pattern 530, whose edges are indicated by solid lines. The first conductive pattern 530 is coupled to a feeding line 590 (e.g. a metal trace), which is disposed on the first planar surface. The second planar surface of the antenna section 510 (e.g. a lower surface) has a second conductive pattern 550, with its edges represented by dashed lines. The planar antenna apparatus 500 also includes a ground plane 520 on the second planar surface of the planar dielectric substrate. Referring to FIG. 5B, a back view of the planar antenna of FIG. 5A is shown. In FIG. 5B, the second conductive pattern 550, whose edges are represented by solid lines, are coupled to the ground plane 520, wherein the first conductive pattern 530 is indicated with dashed edges. The second conductive pattern 550 can also be considered as a portion extended from the ground plane 520, with one or more slots. With the ground plane 520, the first conductive pattern 530 and the second conductive pattern 550 are electrically coupled together so as to serve as the antenna 100. The antenna 100 may be implemented with different lumped circuits equivalent to a cascade of RH and LH transmission lines and different conductive patterns in the antenna section 510 may be laid out differently according to a variety of embodiments of the invention.

EXAMPLES OF LAYOUT

Figure 4B:
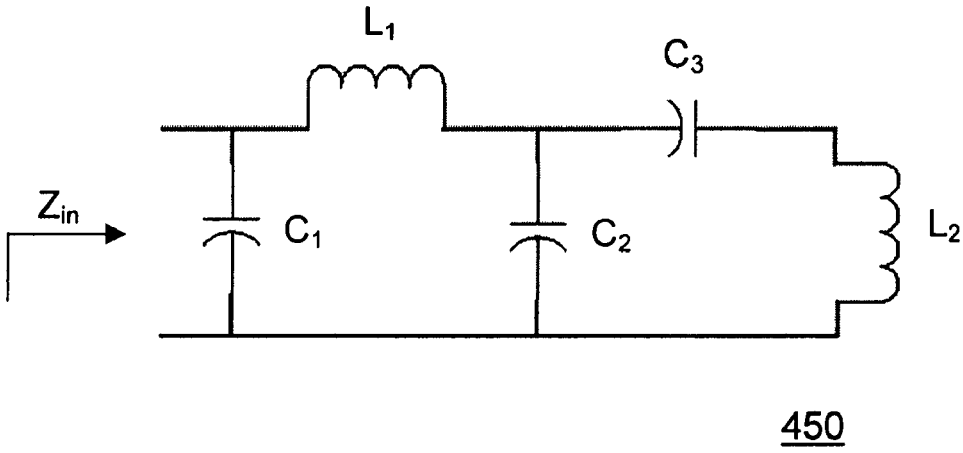
FIG. 4B shows a simplified lumped circuit for the equivalent circuit in FIG. 4A.
Figure 6:
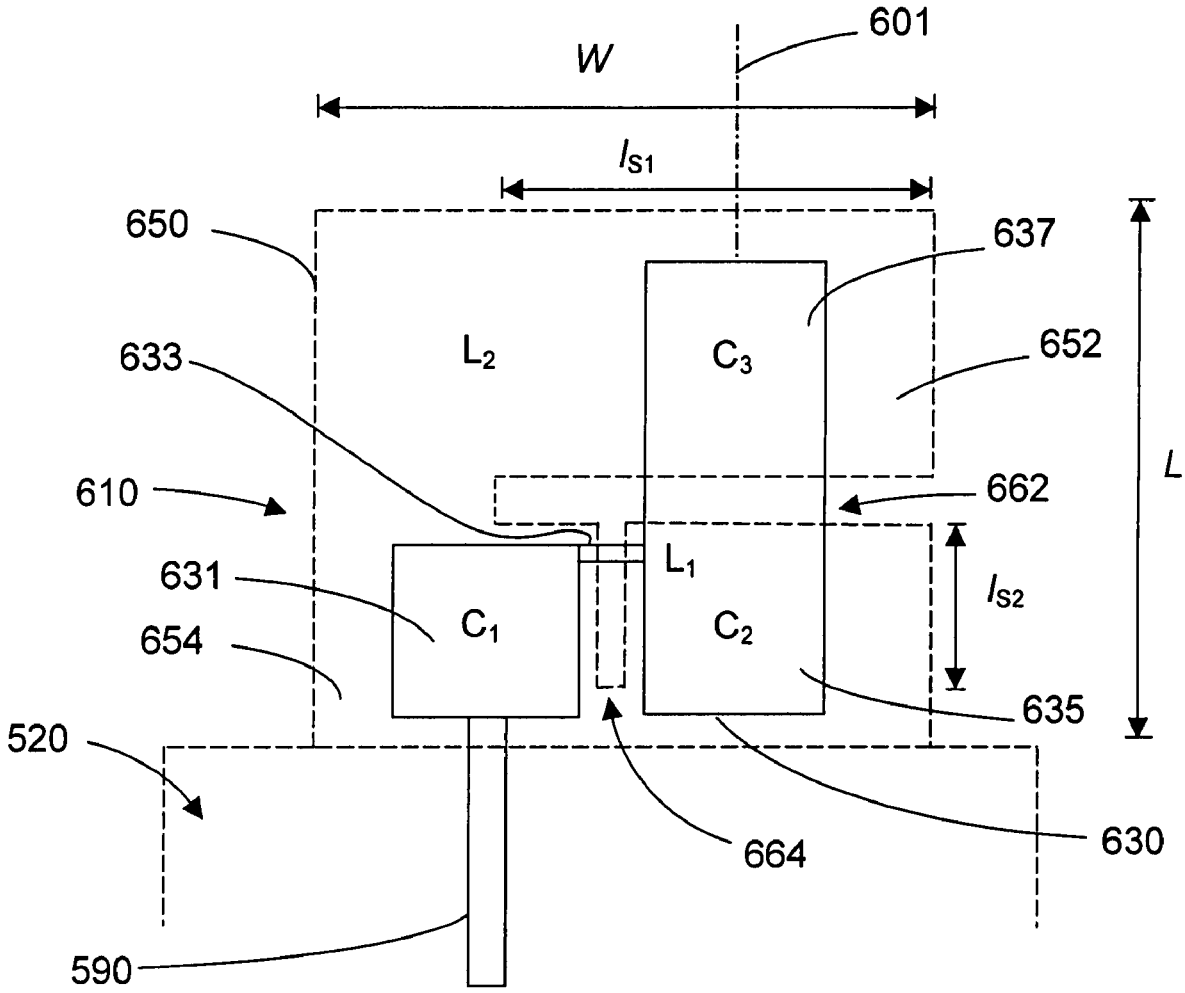
FIG. 6 shows a first example of layout for FIG. 4B on the planar antenna apparatus in FIG. 5A, according to a preferred embodiment of the invention.
Figure 7:
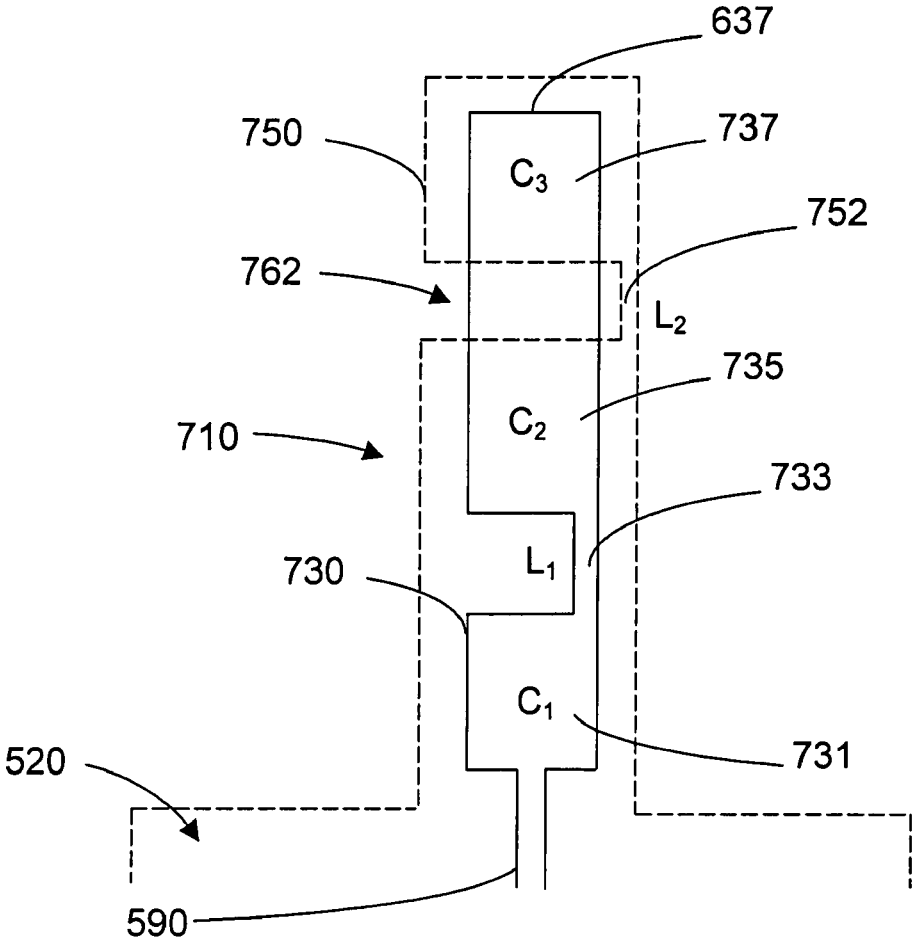
FIG. 7 shows a second example of layout of FIG. 4B on the planar antenna apparatus in FIG. 5A, according to an embodiment of the invention.
Figure 8:
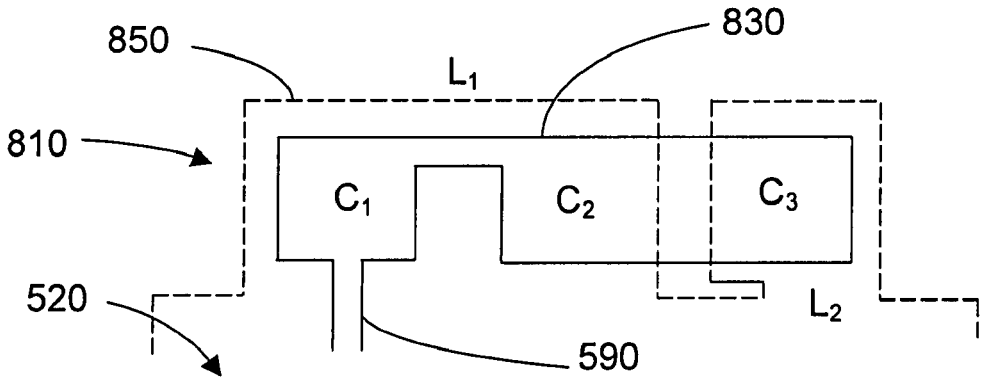
FIG. 8 shows a third example of layout of FIG. 4B on the planar antenna apparatus in FIG. 5A, according to an embodiment of the invention.

Three examples of layout for the lumped circuit 450 in FIG. 4B are provided according to embodiments of the invention, as shown in FIGS. 6-8. In these examples, the operation frequency $f_0$ is taken as 2.45 GHz and the characteristic impedance ($Z_0$) of the LH and RH transmission lines is set to 25 Ohm, i.e. the characteristic impedance of the antenna is of 50 Ohm. For instance, the three capacitors $C_1$, $C_2$, and $C_3$, are taken the same value of 2.6 pF and both of the inductors $L_1$ and $L_2$ have the same value of 1.26 nH at the operation frequency $f_0$ of 2.45 GHz. Additionally, full wave EM simulation by utilizing simulation software, such as Ansoft HFSS, can be applied in aiding design of the layouts.

More specifically, the three examples are made on a two-sided FR4 substrate as the planar dielectric substrate, for instance, with a relative dielectric constant of 4.4 and a thickness of 0.4 mm. As illustrated in FIGS. 6-8, the region whose edges are represented by solid lines indicates the metal layout on a top surface, served as an example of the first conductive pattern 530 of FIG. 5A, and the region whose edges are shown with dashed lines indicates a bottom layout on the bottom surface, served as an example of the second conductive pattern 550. With the ground plane 520, the first conductive pattern 530 and the second conductive pattern 550 are electrically coupled together so as to serve as the lumped circuit 450 for the antenna 100. In addition, rectangular patches are employed to realize metal-insulator-metal (MIM) capacitors while the narrow short metal traces dominantly contribute as inductors, for instance. It should also be noted that all the three examples of layout each have their finite ground plane 520, for instance, of 40 mm by 30 mm in size, extended in the negative y direction, where the ground plane 520 is partly shown in FIGS. 6-8 for simplicity of illustration.

First Example

Referring to FIG. 6, a first example of layout for the lumped circuit 450 in FIG. 4B is illustrated on the planar antenna apparatus in FIG. 5A, according to a preferred embodiment of the invention. In this example, the lumped circuit 450 is implemented in an antenna section 610 in FIG. 6 including a first conductive pattern 630 and a second conductive pattern 650. The first conductive pattern 630, coupled to the feeding line 590, includes a first patch 631, a first trace 633, and a second patch, which includes a first sub-patch 635 and a second sub-patch 637. The second conductive pattern 650 includes a second trace 652 and a third patch 654, coupled to the ground plane 520. The second conductive pattern 650 further includes a first slot 662 under the second patch of the first conductive pattern 630. The second conductive pattern 650 may additionally include a second slot 664 under the first trace 633.

With the ground plane 520, the first conductive pattern 630 is electrically coupled to the second conductive pattern 650 to serve as the lumped circuit 450 for the antenna 100. Specifically, the first patch 631 and the sub-patch 635 of the first conductive pattern 630 are electrically coupled to the third patch 654, which can be regarded as the lower portion of the second conductive pattern 650, to serve as the capacitors $C_1$ and $C_2$ of the lumped circuit 450, respectively. The first trace 633 is coupled between the capacitors $C_1$ and $C_2$ to serve as the inductor $L_1$. The second sub-patch 637 of the first conductive pattern 630 and the second trace 652, which can be regarded as the upper portion of the second conductive pattern 650, are electrically coupled to serve as the capacitor $C_3$ of the lumped circuit 450. In addition, the second trace 652 of the second conductive pattern 650 serves as the inductor $L_2$ and is coupled to the ground through the third patch 654.

As an instance, the geometry parameters of the layout in FIG. 6 are as follows. For the antenna section 650, the length L and the wide W are equal to 11.5 mm. The first patch 631 is chosen as a square metal patch whose side is of 4 mm and the second patch is taken as a rectangular patch of 4 mm by 9.5 mm. The first patch 631 and the second patch are spaced apart by 1.3 mm. The first slot 662 has a length $I_{S1}$, of 9 mm while the second slot 664 has a length $I_{S2}$ of 3.2 mm. Instead of a narrow short trace, this small inductor $L_2$ is realized by a wide and longer metal trace, i.e. the second trace 652. Besides, the additional second slot 664 may be introduced under $L_1$, for instance, with the width of 0.5 mm. It is observed that changing the length $I_{S2}$ of the second slot 664 provides a wide tuning range for the input resistance $Z_{in}$ of the antenna 100 implemented through the lumped circuit 450.

Second Example

Referring to FIG. 7, a second example of layout for the lumped circuit 450 is illustrated on the planar antenna apparatus in FIG. 5A. In this example, the lumped circuit 450 is implemented in an antenna section 710 including a first conductive pattern 730 and a second conductive pattern 750. The first conductive pattern 730, coupled to the feeding line 590, includes a first patch 731, a first trace 733, and a second patch, which includes a first sub-patch 735 and a second sub-patch 737. The second conductive pattern 650 includes a second trace 752 and two patches, coupled to the ground plane 520. The second conductive pattern 750 further includes a slot 762 under the second patch of the first conductive pattern 730. Similar to the layout of the first example, with the ground plane 520, the first conductive pattern 730 is electrically coupled to the second conductive pattern 750 to serve as the lumped circuit 450 for the antenna 100.

Regarding geometry parameters of the layout in FIG. 7, the second conductive pattern 750 is a wide trace of 5.5 mm in width with a narrow trace, for the inductor $L_2$, i.e. the second trace 752, for instance. The first conductive pattern 730 is a less wide trace of 3.5 mm in width with a narrow trace of 2.5 mm in length for L1, i.e. the first trace 733, for instance.

Third Example

Referring to FIG. 8, a third example of layout for the lumped circuit 450 is illustrated on the planar antenna apparatus in FIG. 5A. In this example, the lumped circuit 450 is implemented in an antenna section 810 in FIG. 8 including a first conductive pattern 830 and a second conductive pattern 850. The third example also has similar dimension as that of the second example but the wide traces of the third example are along an edge of the ground plane 520 and the trace for L2 is directly connected to the ground plane 520.

As compared with the first example, the layouts of the second and third examples can be regarded as "straight" layouts with respect the first conductive pattern. For instances, the dimension along the y axis of the antenna section 710 is 18.5 mm and the dimension along the x axis of the antenna section 810 is 18 mm. In contrast, the antenna section 650 has the length L and the wide W equal to 11.5 mm. In other words, the first and second patches of the first conductive pattern of the "straight" layouts in FIGS. 7 and 8 are arranged in a straight line substantially in the direction of the longest side of the first and second patches. For example, the second patch of FIG. 7 has the longest side of the first and second patches and the first patch 731 is arranged in a straight line in the direction of the longest side, i.e. along y axis. In FIG. 6, the second patch also has the longest side of the first and second patches but the first and second patches are not lying on any identical straight line substantially in the direction of the longest side. Instead, with respect to a center axis 601 of the second patch indicated lengthwise in FIG. 6, the first patch 631 is disposed on the left side of the center axis 601. Further, the first patch 631, as well as the first trace 633, can be arranged on the right side of the center axis 601 in other embodiments based on the first example of layout as shown in FIG. 6.

Radiation Mechanism

Figure 9A:
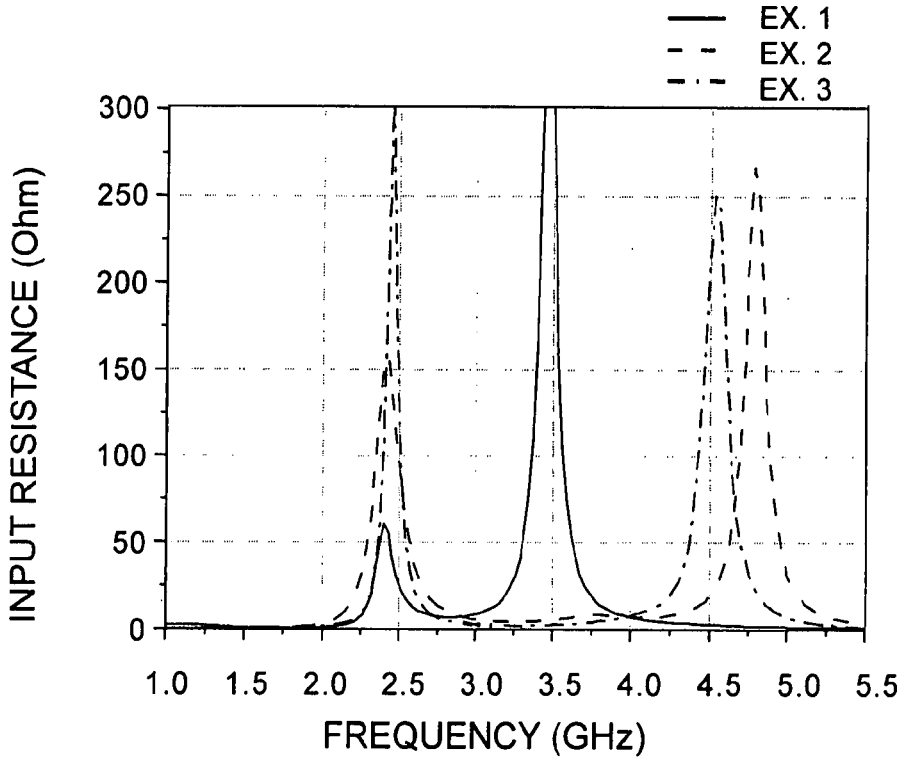
FIGS. 9A and 9B show simulated input impedances of all the three examples of antenna layouts in FIGS. 6-8 for operation frequencies of a range of 1.0 to 5.5 GHz.
Figure 9B:
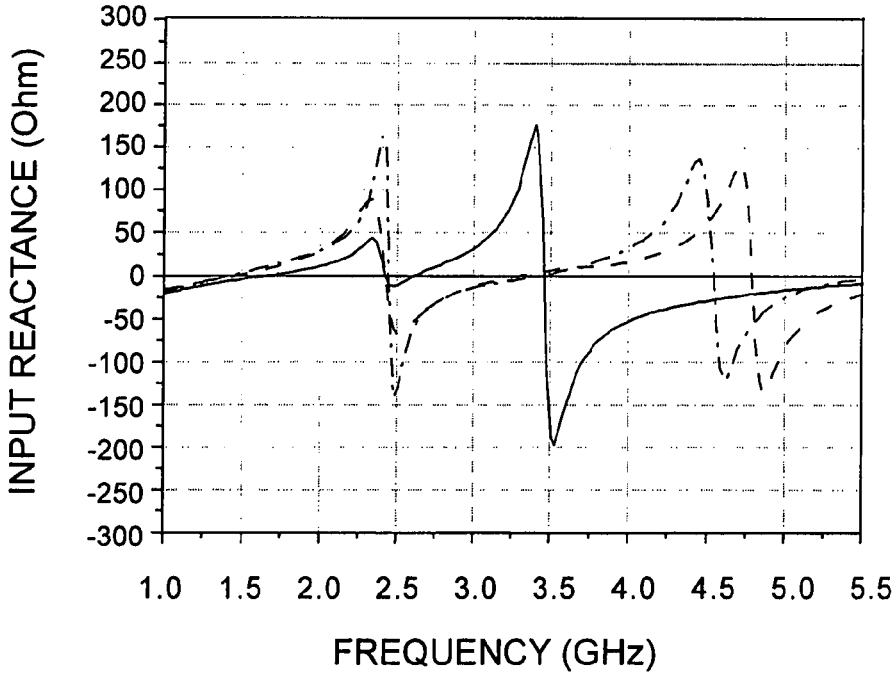

Layouts of antennas affect radiation efficiency significantly as the antenna structure is based on cascaded RH and LH transmission lines. Different layouts cause different electric field and current distributions, which dominate the radiation mechanism. Referring to FIGS. 9A and 9B, the simulated input impedances of all the three examples of antenna layouts in FIGS. 6-8 are illustrated for different operation frequencies of a range of 1.0 to 5.5 GHz. FIG. 9A shows the graphs for their real parts of the input impedances, i.e. the input resistances, while FIG. 9B shows the graphs for their imaginary parts of the input impedances, i.e. the input susceptances. In FIG. 9A and FIG. 9B, solid curves are for the example one (EX. 1), the dashed curves are for the example two (EX. 2), and the dashed-and-dotted curves are for the example three (EX. 3). At a design frequency of 2.45 GHz, all of the three examples of layout have zero imaginary part, as shown in FIG. 9B, but different real parts, as can be observed from FIG. 9A. This indicates that layouts of antennas significantly influence radiation efficiency when the antenna structure is based on cascaded RH and LH transmission lines. It is also observed that a second resonance occurs around the harmonic frequency (4.5 GHz) for both the second and third examples of antennas with straight layout. The first example of antenna also has a second resonance at a lower frequency of 3.5 GHz. Since the design and analysis focus on the performance at the desired fundamental frequency, for example, at 2.45 GHz, other resonances will not be discussed.

Figure 10A:
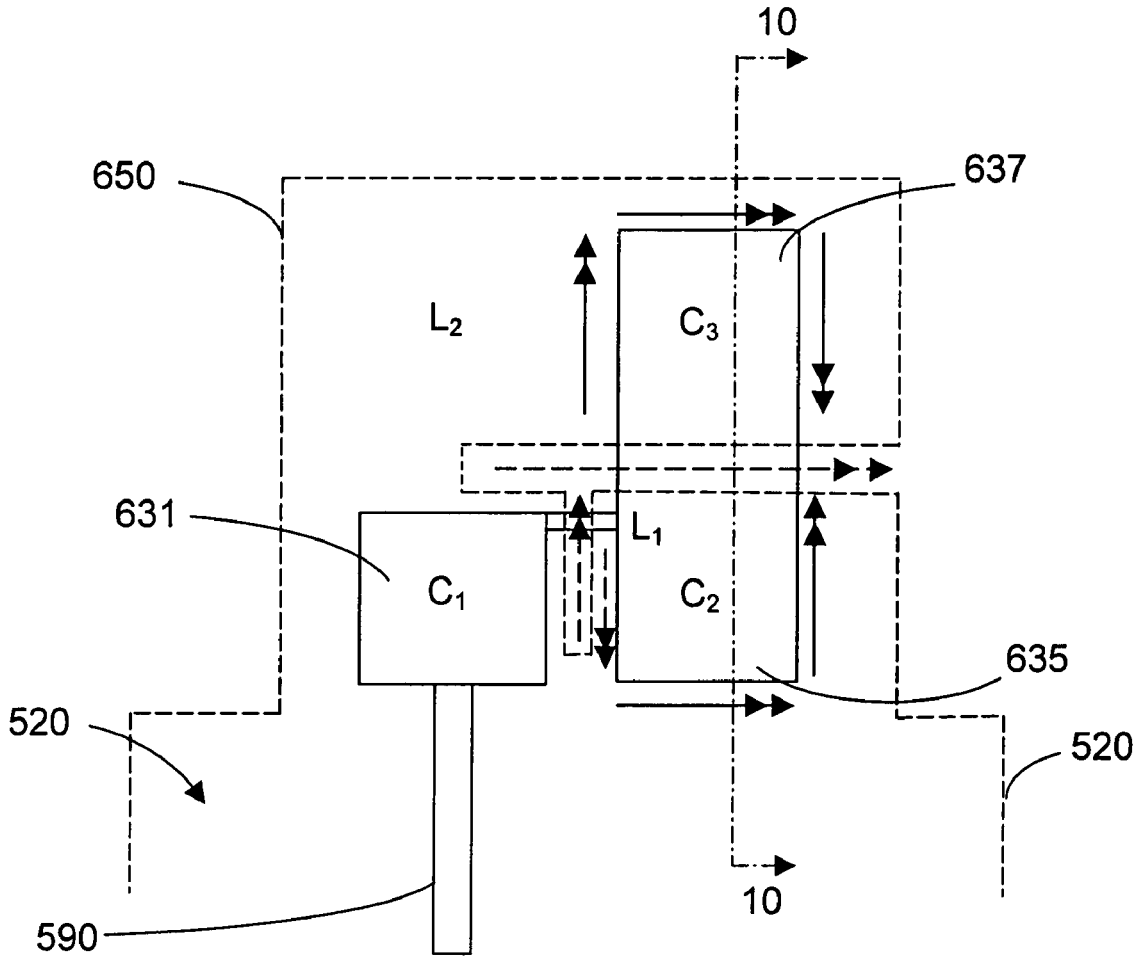
FIG. 10A illustrates the equivalent magnetic current distribution of the first example of layout in FIG. 6 is illustrated with double-headed arrows.
Figure 10B:
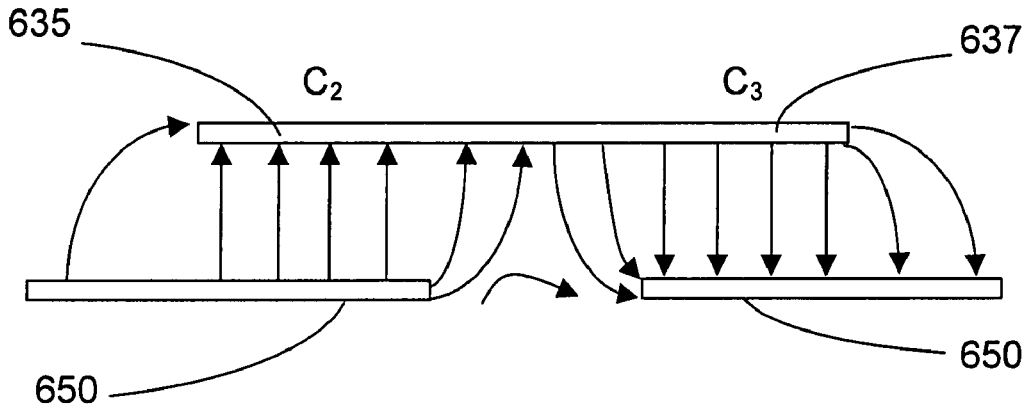
FIG. 10B is a cross-sectional view of the layout in FIG. 10A, taken along line 10-10 of FIG. 10A, for illustrating the electric field distribution of a portion of the layout.

Radiation mechanism of the first example of layout is described. The layout of the first example has a topology of patches at the first planar surface (e.g. the top surface) and slots at the second planar surface (e.g. the bottom surface). In addition, the second conductive pattern 650 can be considered or implemented as the extended ground plane with two connected orthogonal slots. In the first example of layout, the MIM capacitors confine electric energy and provide fringing fields at their edges. Referring to FIG. 10A, the equivalent magnetic current distribution of the first example of layout in FIG. 6 is illustrated with double-headed arrows. Referring also to FIG. 10B, a cross-sectional view taken along line 10-10 of FIG. 10A illustrates the electric field distribution of a portion of the layout. In FIG. 10B, the electric field distribution of the second patch including the sub-patches 631 and 637 with respect to the second conductive pattern 650 is illustrated with arrows, wherein the dielectric substrate is not shown for the sake of brevity. As can be seen in FIG. 10B, the electric field for capacitors $C_2$ and $C_3$ has opposite polarities, i.e. the electric field vectors for $C_2$ point upward while those for $C_3$ point downward. Thus, the equivalent magnetic current from the capacitor $C_2$ flows counterclockwise while that from the capacitor $C_3$ flows clockwise, as indicated by the double-headed arrows of FIG. 10A. In addition, close and opposite-directed pairs of the magnetic currents cancel each other out. Therefore, there are two edges of the second patch on the first planar surface constructively contributing to radiation. These two edges provided by the upper portion of the capacitors $C_2$ and $C_3$, as indicated by the sub-patches 635 and 637 in FIG. 10B, operate substantially as the radiating edges of a conventional half-wavelength patch antenna. Moreover, there are two connected slots at the bottom side offering aperture electric field for constructing radiation. On the other hand, the contribution provided by the first patch 631, i.e. the capacitor $C_1$, is not taken into account since its field strength is very weak. In the first example, the free space wavelength $\lambda_0$ with respect to the operation frequency $f_0$ of 2.45 GHz is about $3\times10^8/2.45\times10^9=0.12245$ m and the length L and the wide W of the antenna section 650 are equal to 11.5 mm, for instance. In other words, the layout of the first example shrinks the dimension of antenna from half wavelength to one-tenth wavelength.

The first example of layout can also be interpreted as closing the layout for the inductor $L_2$ to the bottom side of the capacitor $C_1$. The surface electric current flow is guided roughly in a loop in the order of $C_1$, $L_1$, $C_2$, $C_3$, $L_2$ and then returns to $C_1$. It results in the cancellation of the opposite current flows at the capacitor $C_1$, i.e. the first patch 631, which makes the field intensity weak at the first patch 631 ($C_1$) and strong at the sub-patch 635 ($C_2$). Thereby, two sub-patches for the capacitors $C_2$ and $C_3$ with intense field form four constructively radiating edges, two at the top and two at the bottom. Different from the first example of layout, the layout for the inductor $L_2$ in the second example directly connects to the nearest element $C_2$, which causes weak field intensity at the capacitor $C_2$. The consequence of the intense field at the capacitor $C_1$ as an individual small patch does not contribute to radiation. As a result, the layout of the first example offers more radiating edges and is considered as a more efficient layout with respect to radiating structures. The aperture electric field contributes to radiating from the connected slots at the second conductive pattern 650.

Figure 11A:
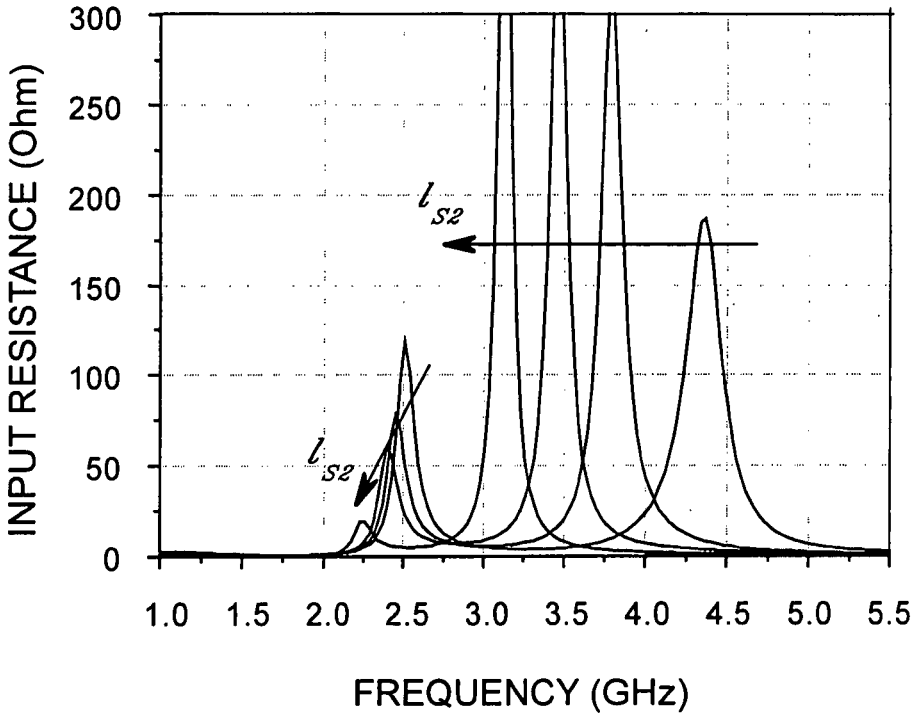
FIGS. 11A and 11B show simulated real part and imaginary part of the input impedance for the first example of layout respectively, with the slot length $I_{S2}$ under L1 being different values.
Figure 11B:
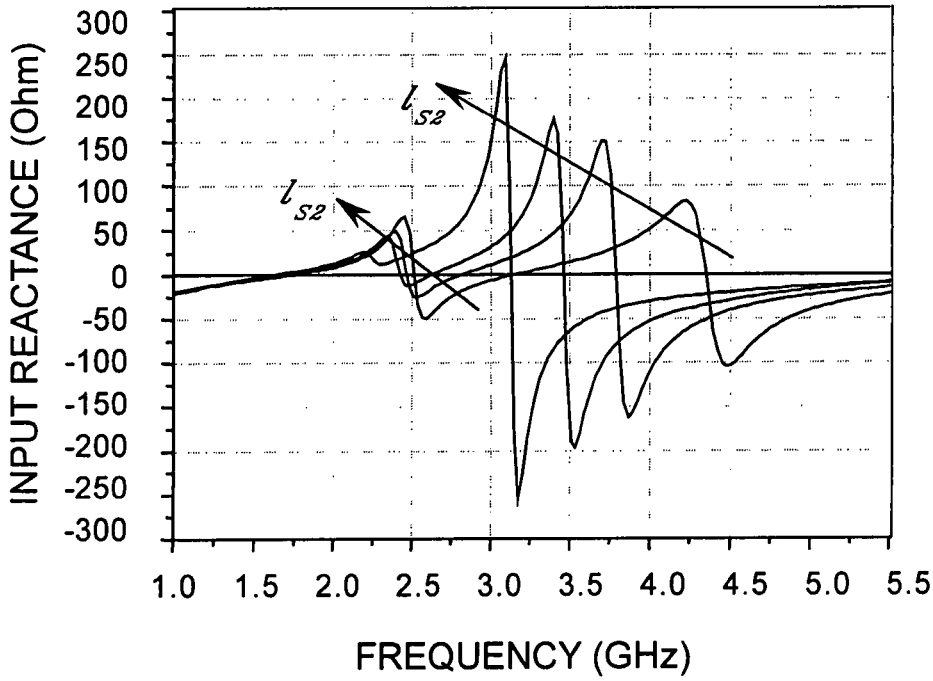

Furthermore, the slot under the inductor L1 is introduced to avoid the image electric current of the inductor L1 for shortening the trace length of the inductor L1. Referring to FIGS. 11A and 11B, simulated real part and imaginary part of the input impedance for the first example of layout are shown respectively, with the slot length $I_{S2}$ under L1 being 1.5, 3.0, 3.5, and 4.5 mm. The directions of arrows in FIGS. 11A and 11B show the trend of value changing of the real part and imaginary part of the input impedance for the different values of slot length $I_{S2}$. It is found that the slot length, $I_{S2}$, can be used to reduce the input resistance of the antenna from hundreds of Ohms to a few Ohms, as can be observed from FIGS. 11A and 11B. Moreover, the aperture electric field from this shorter slot does not destruct other radiating contribution since it is orthogonal to the others.

EXPERIMENTAL VERIFICATION

For experimental verification, both the first and second examples of layout are fabricated and measured. These two antennas according to the examples were implemented on an FR4 substrate with relative dielectric constant of 4.4 and thickness of 0.4 mm. According to the first example of layout, an antenna results in occupying an area of 11.5 mm square with a connected ground size of 40 mm by 35 mm. According to the second example of layout, another antenna has the size of 5.5 mm by 18.5 mm with the same ground size as the one according to the first example. The two antennas both are fed at the end of the microstrip line by 50-Ω coaxial cable from the back side. As the simulation result expected, the input resistance of the antenna according to the second example is about 150Ω, which is relatively large for the 50-Ω system. Thus, in implementation, an extra quarter-wavelength high impedance line is added between the capacitor $C_1$ and the 50-Ω microstrip feeding line for impedance transformation.

Figure 12:
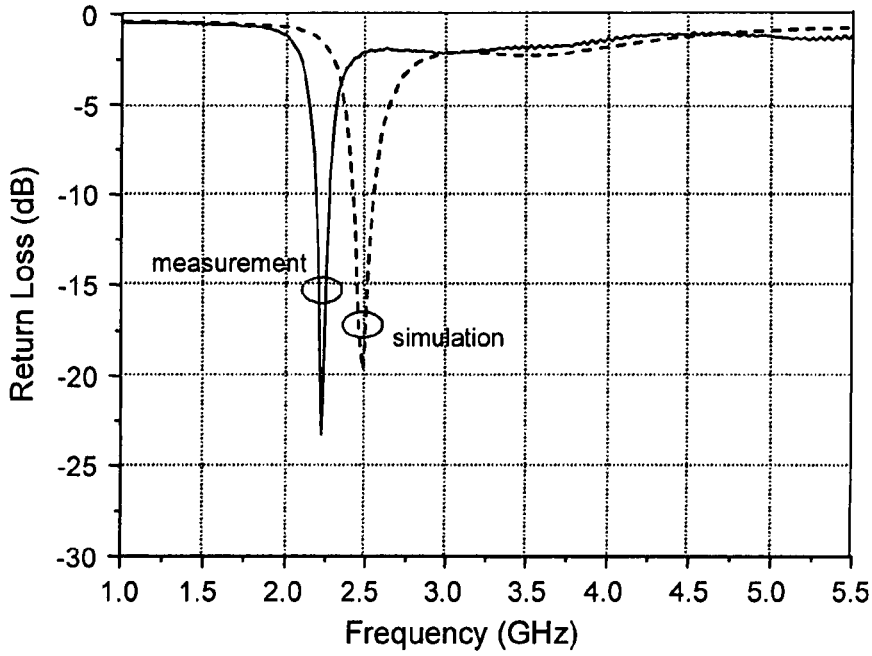
FIG. 12 shows the measured and simulated return losses, as functions of frequency, for the antenna according to the first example and the antenna according to the second example.
Figure 13:
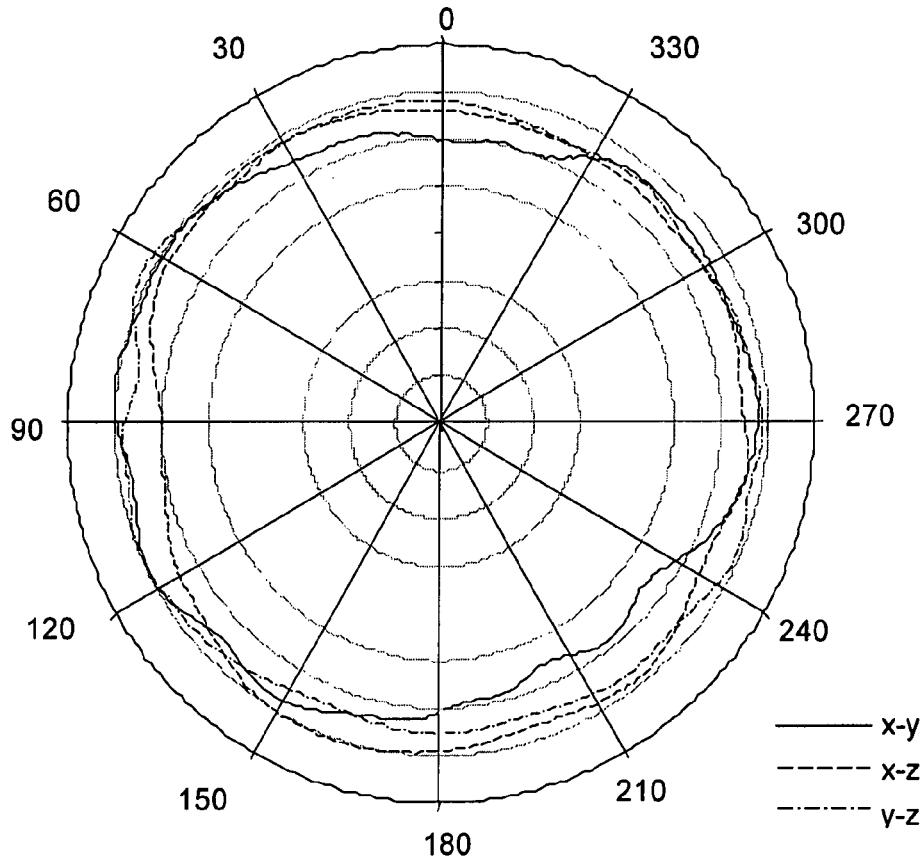
FIG. 13 shows the measured radiation patterns for the antenna according to the first example in x-y, y-z, and x-z planes.

FIG. 12 shows the measured and simulated return losses, as functions of frequency, for the antenna according to the first example, as indicated by the solid curve, and the antenna according to the second example, as indicated by the dashed lines. Both the measurement results shift a little in frequency from the desired 2.45 GHz. The antenna according to the first example exhibits a resonant frequency at 2.23 GHz with the measured return loss of 23 dB, whereas the antenna according to the second example is at 2.35 GHz with a return loss of 16 dB. The corresponding 10-dB return loss bandwidths are 4.5% and 5.3%, respectively. Both the fabricated antennas have fairly omnidirectional far field radiation patterns in the three principal planes. FIG. 13 shows the measured radiation patterns for the antenna according to the first example in x-y, y-z, and x-z planes with average gains of −2.04, −1.41, −1.02 dBi, respectively, wherein the solid curve is for radiation pattern in x-y plane, the dashed curve is for radiation pattern in x-z plane, and the dashed-and-dotted curve is for radiation pattern in y-z plane. The antenna according to the second example in x-y, y-z, and x-z planes has the average gains of −2.01, −1.72 and −1.80 dBi, respectively. The peak gain is +0.16 dBi for the antenna according to the first example and is −0.54 dBi for antenna according to the second example.

According to the embodiments of the invention, a planar antenna is provided, on which a planar antenna apparatus and communication apparatus can be based. According to the invention, compact antennas based on cascaded right- and left-handed transmission lines are achieved. By applying different equivalent transmission line models, the physical dimension can be compact ($\lambda_0/12$) with providing more radiating edges. In some embodiments with the π and T models, for example, exact formulas for L and C for almost all-range electrical length, θ can be obtained for design requirements. By contrast, CRLH TL of which formulas for the circuit elements are valid for very small θ with the same accuracy as sine approaches unity. Instead of only half-space patch-like radiation, the embodiment according to the first example with more than two radiating edges gives all the three principal planes fairly omnidirectional radiation patterns. Moreover, different layouts for a same circuit model according to the invention can cause different performances.

Additionally, although the equivalent circuit parameters in the above embodiments and different examples are chosen for illustration, different electrical length, different characteristic impedance, or different equivalent models are still possible to be applied, according to the invention.

While the invention has been described by way of examples and in terms of embodiments with a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A planar antenna apparatus comprising:

a dielectric substrate having a first surface and a second surface opposite to the first surface;

a ground plane on the second surface of the dielectric substrate;

a feeding line disposed on the first surface of the dielectric substrate;

an antenna section based on a portion of the dielectric substrate, comprising:

a first conductive pattern disposed on the first surface of the portion of the dielectric substrate, the feeding line being coupled to the first conductive pattern, wherein the first conductive pattern comprises: a first patch coupled to the feeding line; a first trace coupled to the first patch; and a second patch, coupled to the first trace, comprising a first sub-patch and a second sub-patch;

a second conductive pattern disposed on the second surface of the portion of the dielectric substrate and connected to the ground plane, wherein first conductive pattern is coupled to the second conductive pattern so as to serve as a cascade of a right-handed transmission line and a left-handed transmission line;

wherein the first and second conductive patterns comprise:

a first lumped equivalent circuit of the right-handed transmission line; and a second lumped equivalent circuit of the left-handed transmission line, cascaded with the first lumped equivalent circuit, wherein the right-handed and left-handed transmission lines have electrical lengths with opposite signs respectively.

2. The planar antenna apparatus according to claim 1, wherein the first lumped equivalent circuit comprises a π-model circuit.

3. The planar antenna apparatus according to claim 1, wherein the first lumped equivalent circuit comprises a T-model circuit.

4. The planar antenna apparatus according to claim 1, wherein the second lumped equivalent circuit comprises a π-model circuit.

5. The planar antenna apparatus according to claim 1, wherein the second lumped equivalent circuit comprises a T-model circuit.

6. The planar antenna apparatus according to claim 1, wherein the first lumped equivalent circuit comprises a π-model circuit and the second lumped equivalent circuit comprises a T-model circuit.

7. The planar antenna apparatus according to claim 1, wherein the first lumped equivalent circuit comprises a π-model circuit and the second lumped equivalent circuit comprises a T-model circuit and the T-model circuit has one open-circuited port.

8. The planar antenna apparatus according to claim 1, wherein the second conductive pattern comprises:

a first slot under the second patch and between the first and second sub-patches.

9. The planar antenna apparatus according to claim 8, wherein the second conductive pattern further comprises:

a second slot under the first trace.

10. The planar antenna apparatus according to claim 9, wherein the first and the second slots are connected.

11. The planar antenna apparatus according to claim 10, wherein the first slot is orthogonal to the second slot.

12. The planar antenna apparatus according to claim 1, wherein the dielectric substrate is a printed circuit board.

13. An planar antenna structure comprising:

a dielectric substrate having a first surface and a second surface;

a ground plane on the second surface of the dielectric substrate;

a first conductive pattern on the first surface of the dielectric substrate, coupled to a feeding line, wherein the first conductive pattern comprises: a first patch coupled to the feeding line: a first trace coupled to the first patch; and a second patch, coupled to the first trace, comprising a first sub-patch and a second sub-patch;

a second conductive pattern on the second surface of the dielectric substrate, coupled to the ground plane, wherein the first conductive pattern is coupled to the second conductive pattern so as to serve as a cascade of a right-handed transmission line and a left-handed transmission line, wherein the first and second conductive patterns comprise:

a first lumped equivalent circuit of the right-handed transmission line; and a second lumped equivalent circuit of the left-handed transmission line, cascaded with the first lumped equivalent circuit, wherein the right-handed and left-handed transmission lines have electrical lengths with opposite signs respectively.

14. The planar antenna structure according to claim 13, wherein the second conductive pattern comprises:

a first slot under the second patch and between the first and second patches.

15. The planar antenna structure according to claim 14, wherein the second conductive pattern further comprises:

a second slot under the first trace.

16. The planar antenna structure according to claim 15, wherein the first and the second slots are connected.

17. The planar antenna structure according to claim 16, wherein the first slot is orthogonal to the second slot.

18. The planar antenna structure according to claim 13, wherein the dielectric substrate is a printed circuit board.

* * * * *